United States Patent [19]

Deveney

[11] Patent Number: 4,746,118

[45] Date of Patent: May 24, 1988

[54] BATTING AID

[76] Inventor: Dennis Deveney, 27 Lindbergh Pkwy., Waldwick, N.J. 07463

[21] Appl. No.: 880,147

[22] Filed: Jun. 30, 1986

[51] Int. Cl.[4] ..... A63B 69/40

[52] U.S. Cl. ..... 273/26 C; 273/190 A

[58] Field of Search ..... 273/26 R, 26 C, 29 A, 273/188 R, 189 R, 190 R, 190 A, 37, 190 B, DIG. 17, 54 B, 190 C

[56] References Cited

U.S. PATENT DOCUMENTS

| | | | |
|---|---|---|---|
| 3,059,932 | 10/1962 | Smallwood | 273/190 |
| 3,148,375 | 9/1964 | Jones | 273/190 A |
| 3,302,214 | 2/1967 | Yuritch | 273/DIG. 17 |
| 3,346,257 | 10/1967 | Whitney | 273/26 |
| 3,697,065 | 10/1972 | Glassburner, Jr. | 273/190 R |
| 3,713,657 | 1/1973 | Presta | 273/19 R |
| 3,779,549 | 12/1973 | MacNeil | 273/190 C |
| 4,300,765 | 11/1981 | Stringham | 273/26 C |
| 4,527,982 | 7/1985 | Salzman | 273/29 A |

*Primary Examiner*—Richard C. Pinkham
*Assistant Examiner*—T. Brown
*Attorney, Agent, or Firm*—Herbert L. Lerner; Laurence A. Greenberg

[57] ABSTRACT

A batting aid for training a batter to keep his eyes on the ball thrown by the pitcher while the batter is swinging at the ball. The aid includes structure connected between the batter's helmet worn by the batter and the shoulder of the batter that will restrict movement of the batter's head during his swing at the ball. One embodiment employs a flexible strap which passes through the helmet and is secured about the batter's shoulder. Another verison uses a rigid member connected at an end to the helmet and at its opposite end with the batter's shoulder. Additional structure can be added to the opposite side of the helmet which engage the batter's opposite shoulder to further restrict the tendency of the batter to turn his head away from the pitched ball and lose eye contact with it during his swing.

11 Claims, 3 Drawing Sheets

BATTING AID

BACKGROUND OF INVENTION

1. Field of Invention

The present invention relates to a batting aid to assist a batter in maintaining proper eye contact with a pitched ball and more particularly, to an improved batting aid that will force the batter to keep his eye on the ball by limiting him from turning his head in an undesirable way from the ball.

2. Description of the Prior Art

It is well recognized in the game of baseball that it is very important for the player to make eye contact from the time the ball is thrown by the pitcher until the ball is in the zone or area where the batter swings to make contact with the ball. The usual tendency is for the batter to turn his head away from the ball as it is thrown, thereby losing eye contact with the ball. This often results in the batter not making bat contact with the ball when he swings the bat. A prior art device for maintaining eye-on-ball contact during a swing is disclosed in U.S. Pat. No. 4,300,765. In this patent, there is disclosed a batting aid comprising a shoulder piece connected to a jaw piece, located between the batter's chin and shoulder. The relative pressure exerted by the device is used to tell the batter if his head and shoulder are in the relative proper position. There is, however, no means for maintaining a fixed relative position between the batter's shoulder and head. Another prior art patent is U.S. Pat. No. 3,697,065, which illustrates a training aid for a runner, including the use of straps located over the shoulder and around the chest to maintain a plate in position. Other prior art patents are U.S. Pat. Nos. 3,059,932, and 3,346,257, which illustrate the expedient of using flexible straps to hold training devices in position on an individual's body.

These prior art devices suffer from various deficiencies which are not present in this invention. For example, they do not provide a batting aid which maintains a relative fixed position between the batter's shoulder and head, which allows the batter to achieve eye-on-ball contact until contact is made with the ball during the swinging of the bat. The present invention provides a simple and inexpensive device which aids substantially in achieving this desirable object.

SUMMARY OF THE INVENTION

The present invention comprises a batting aid device which in a preferred embodiment includes means such as a strap or rigid member connected at an end to a batting helmet and at its other end to the shoulder of the batter. According to an embodiment this comprises a strap which passes through the helmet in the area of the ear protective piece and is secured about the batter's shoulder to provide limited restrictive movement between the helmet and the batter's shoulder. Thus, eye contact is maintained with the pitched ball. Another embodiment uses a rigid member that is connected between the batter's helmet and the batter's shoulder to perform the same function as previously described. A further embodiment may include a combination of the strap and rigid member. To accommodate different batters, the strap and rigid member are designed to be adjustable in length. Additionally, to ensure that the batter's head is maintained in the desired position, the helmet should fit snugly on the batter's head.

A primary object of this invention is to provide an improved batting aid that will assist a batter in holding his head in proper position and maintaining eye on the ball contact.

Another object of the invention is to provide a simple, inexpensive and efficient improved batting aid device for maintaining eye on the ball contact.

These and other objects and advantages of the present invention will become apparent from the following description of the preferred embodiments of the present invention when considered in conjunction with the accompanying drawings.

DESCRIPTION OF PREFERRED EMBODIMENTS

Figure 1:
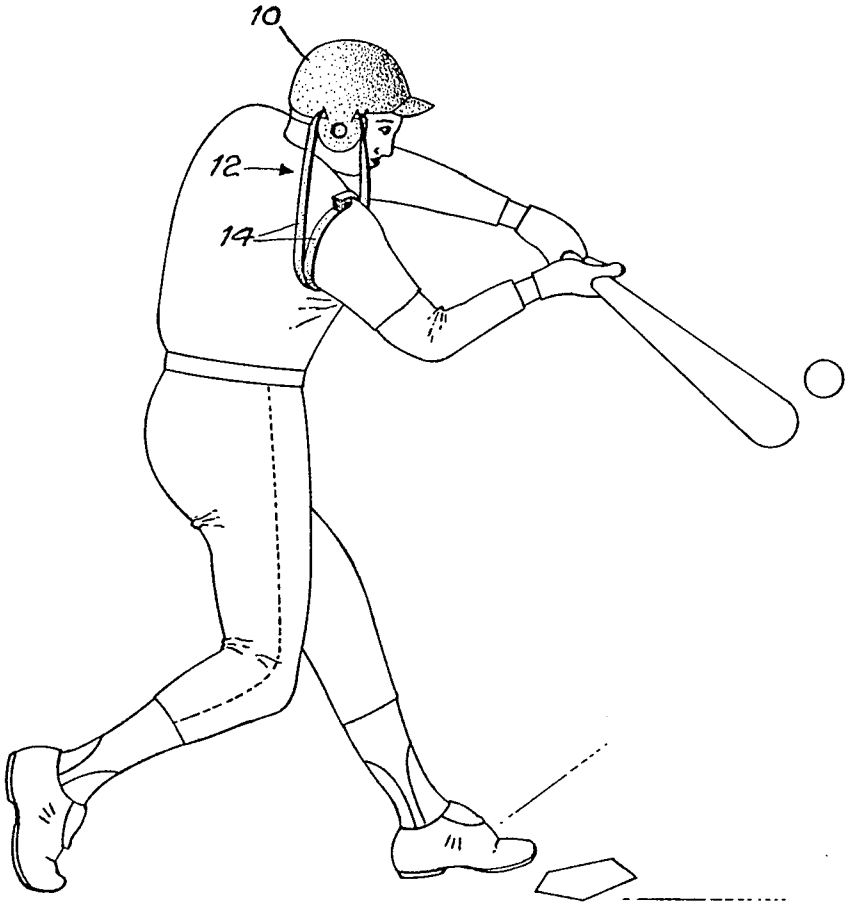
FIG. 1 is a view of a batter in a batting stance wearing a batting aid according to the present invention.
Figure 4:
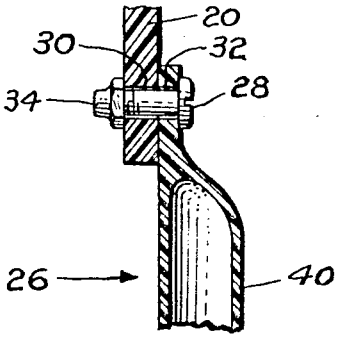
FIG. 4 is a cross-sectional view taken substantially on the line 4—4 of FIG. 3.

Referring to the drawings wherein like parts are designated by the same reference numeral throughout the several views, there is illustrated in FIG. 1, a batter in a batting stance swinging at a pitched ball and wearing a helmet 10 that incorporates a batting aid 12 according to the present invention. Normally, a batter tends to turn his head to the left for a batter who bats right-handed, as the ball is thrown by the pitcher while he is swinging at the pitch. By turning, the batter takes his eye off the ball which causes him to miss the ball. The aid will force the batter to keep his eye on the ball by limiting turning of his head (to the left for a right-handed batter and to the right for a left-handed batter). It also prevents the batter from lifting his head as he swings which can also cause him to miss the ball. However, the aid still permits movement by the batter to avoid a badly thrown pitch.

Figure 2:
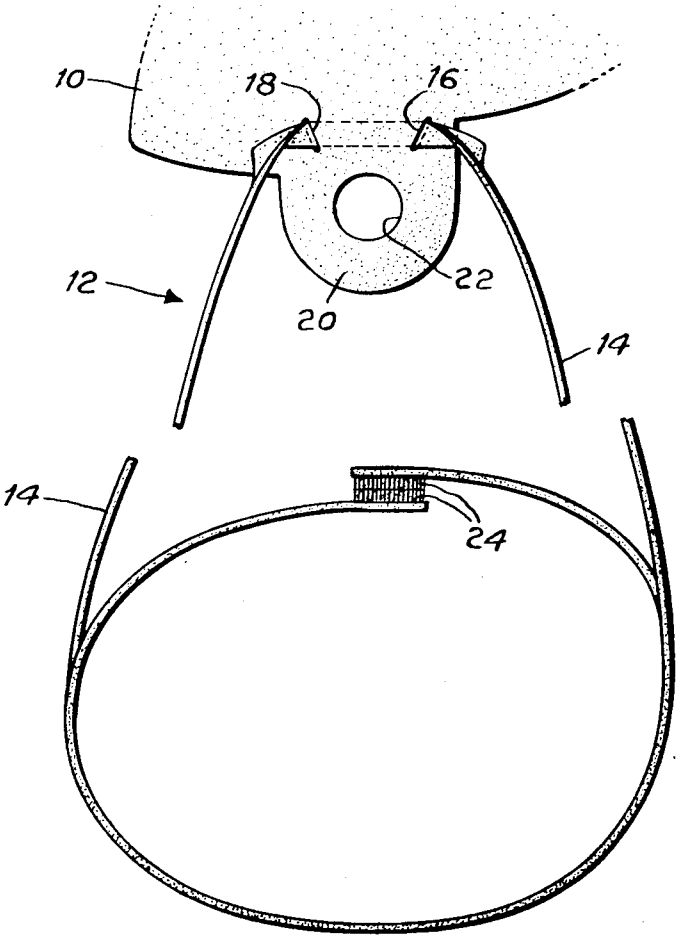
FIG. 2 is an enlarged side view of a preferred embodiment of a batting aid with straps according to the present invention.

The aid, in its preferred embodiment as best shown in FIGS. 1 and 2, comprises a flexible strap 14 which passes through a pair of slotted openings 16, 18 formed in the batting helmet 10. These openings are located slightly above the ear protecting piece 20 of the helmet on either side of the ear opening 22. The strap, which is preferably made of leather, is sufficiently long to extend down to the batter's shoulder such that opposite ends thereof wrap around the shoulder and under the arm pit in opposite directions. The straps have fastening means, such as hook and pile tape sold under the trademark "Velcro", portions 24 attached at the ends thereof on opposed sides of the strap so that when they are brought into overlying juxtaposed relation, as shown in FIG. 2, the "Velcro" portions will cooperatively interlock and securely hold the strap on the shoulder. Other suitable means for fastening the strap in place, for example, a buckle arrangement or self-locking slots, also could be employed. It is desirable that the helmet fit snugly on the batter's head so that as the right-handed batter tends to turn his head to the left, the restraining strap will limit relative movement between the batter's head and shoulders. The reverse arrangement can be used for left-handed batters. By providing the fastening means at the ends of the strap, the length of the strap between the helmet and shoulder may be adjusted to fit the particular batter.

Figure 3:
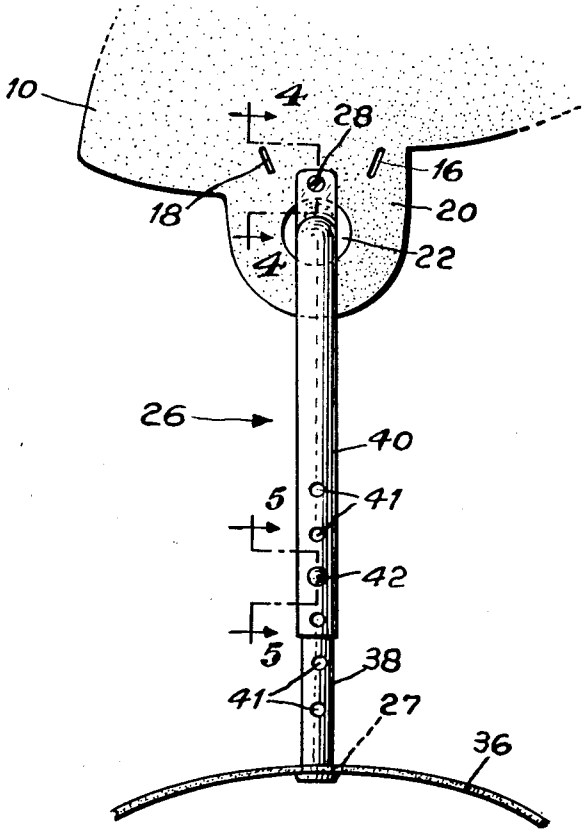
FIG. 3 is an enlarged side view of another embodiment of a batting aid with a rigid member according to the present invention.

Another embodiment of the invention is shown in FIG. 3. This version employs a rigid member 26, which may be metal or plastic. The member is adjustable in length and is connected at one end to the helmet proximate to and above the ear opening 22 in the ear piece 20 by suitable means. One such means is shown as a round-headed screw 28 which passes through an opening 30 in the helmet and an opening 32 in the end of the member 26. A smooth, round-headed capscrew 34 is threaded onto the end of the screw 28 to secure the member to the helmet. Other suitable fastening means, such as a rivet is also possible. At the opposite end, the member 26 is secured in place relative to the batter's shoulder by means of a strap 36 which passes through an opening 27 provided at the bottom of the member 26, and wraps around the batter's shoulder. "Velcro" end portions also can be used to hold the strap 36 in place, as above described in respect to strap 14.

Figure 5:
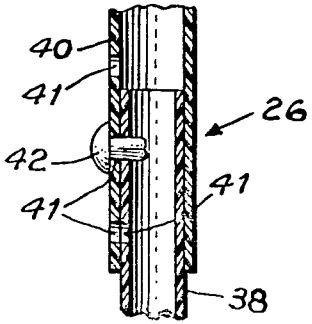
FIG. 5 is a cross-sectional view taken substantially on the line 5—5 of FIG. 3.

The member 26 can be made adjustable by forming the member of two coaxial telescoping tubular members 38, 40. As shown in FIG. 5, a standard spring-biased button 42 protrudes through openings 41 in the walls of the members 38 and 40 to releasably lock the members in the desired extended position. Other locking means may be used to provide for adjustment in the length of the member 26.

Figure 6:
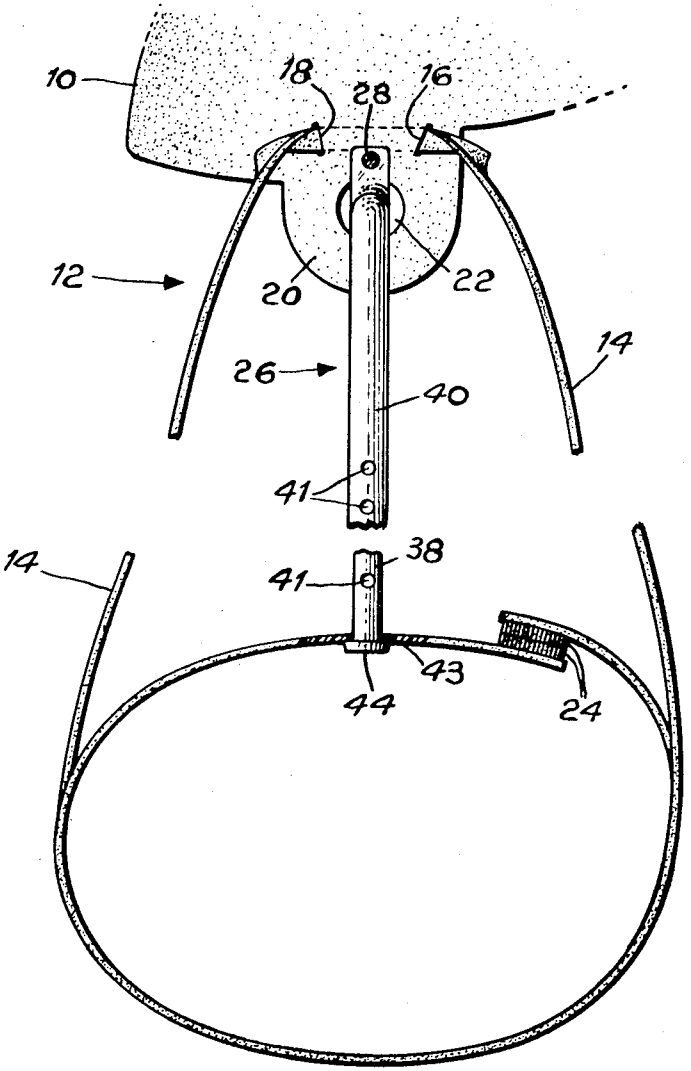
FIG. 6 is an enlarged side view of a further embodiment of a batting aid combining straps and a rigid member according to the present invention.

A further embodiment of the present invention comprises employing the rigid member 26 and the strap 14 as illustrated in FIG. 6. The rigid member 26 may be secured to the flexible strap 14 by providing an opening 43 in one end of the flexible strap proximate to and rearward of the fastening means 24 on one end of the strap 14 and providing a compressible knob or button 44 on the lower end of rigid member 26 to removably secure the rigid member on to said strap. Thus, when the length of the rigid member is adjusted to cause the head to be held in the proper position and the end of the flexible strap secured around the batter's shoulder to make the strap portions taut, the device forms a very effective head positioning device.

Figure 7:
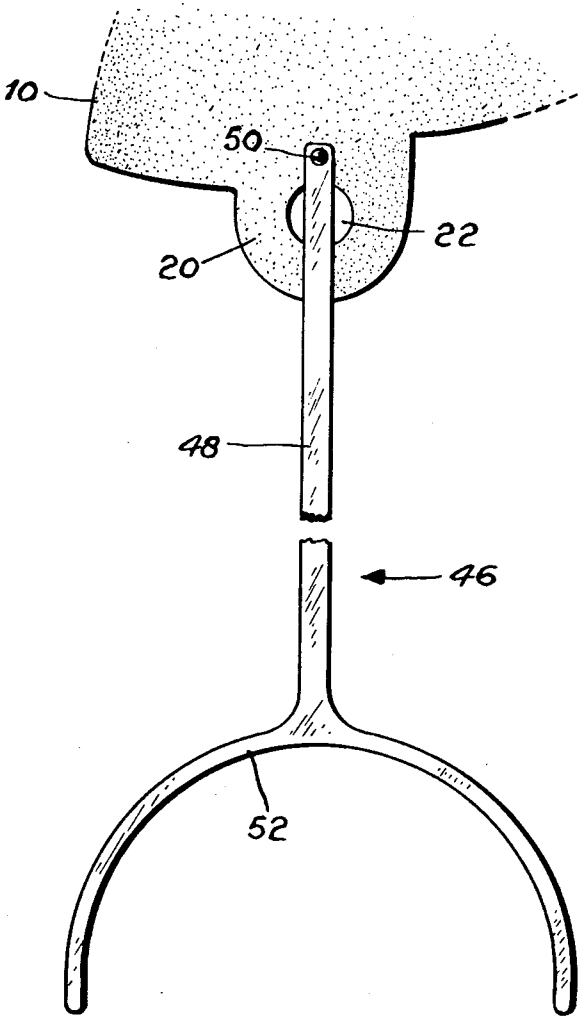
FIG. 7 is an enlarged side view of a modification to the present invention.

An optional modification to the foregoing is best shown in FIG. 7. On the side of the helmet opposite from the side on which the batting aid is located may be provided additional means for restricting movement of the batter's head. This comprises a rigid brace 46 comprising an elongated stem portion 48 secured at its end to the helmet by means 50 such as, a screw or rivet which will permit member 46 to pivot. The stem supports a U-shaped member 52 whose concave opening fits over the batter's shoulder to restrict the tendency of the batter's head to turn to the left in the case of a right-handed batter. For a left-handed batter, the member is located on the right side of the batting helmet.

It should be understood that the present invention is subject to many variations, modifications and changes in detail. However, it is intended that all matter contained in the foregoing description or shown in the accompanying drawings shall be interpreted as illustrative only, and not in a limiting sense.

The invention claimed is:

1. An improved batting aid for a batter in combination with a batting helmet worn by a batter, comprising restraining means of predetermined length disposed between the helmet and the shoulder of the batter, said restraining means cooperatively engaging said helmet and including means for securing said restraining means with the shoulder of a batter such that said helmet and the shoulder are maintained in a relatively fixed position and turning of the head of a batter is limited in movement in at least one direction.

2. An improved batting aid according to claim 1 wherein said restraining means comprises an adjustable rigid member first means connecting said rigid member at one end directly to said helmet, flexible means securing the opposite end of said rigid member with the shoulder of the batter.

3. An improved batting aid according to claim 2, wherein said rigid member comprises a pair of telescoping tubular members formed with means for releasably maintaining said members at a desired length between said helmet and shoulder.

4. An improved batting aid according to claim 3 wherein said rigid member is made of plastic.

5. An improved batting aid according to claim 3, wherein said restraining means comprises a strap extending through openings in said helmet and a rigid member disposed between said helmet and the shoulder of the batter, and flexible means for connecting said strap and said rigid member with said the shoulder.

6. An improved batting aid according to claim 1, including a rigid brace secured to said helmet on the side opposite said restraining means and extending into supporting contact with the other shoulder of the batter.

7. An improved batting aid according to claim 6, wherein said rigid brace comprises a stem connected at one end with said helmet and a concave portion carried by said stem and disposed for conforming contact with the batter's shoulder.

8. An improved batting aid according to claim 1, wherein said restraining means comprises a flexible strap extending through a pair of openings in said helmet, said strap including fastening means, said strap disposed about the shoulder of the batter and said fastening means cooperatively engaging each other to secure said strap about the shoulder.

9. An improved batting air for a batter in combination with a batting helmet worn by a batter, comprising restraining means of predetermined length disposed between the helmet and the shoulder of a batter, said restraining means including a flexible strap extending through a pair of openings in said helmet for cooperatively engaging said helmet, said strap including means for securing said restraining means with the shoulder of a batter such that said helmet and the shoulder are maintained in a relatively fixed position and have limited restrictive movement relative to each other, and said strap including fastening means at opposite ends thereof, the opposite ends of said strap disposed about the shoulder of the batter and said fastening means cooperatively engaging each other to secure said strap about the shoulder.

10. An improved batting aid according to claim 2 wherein said strap is continuous.

11. An improved batting aid according to claim 2 wherein said fastening means are located on opposite surfaces of said strap and are self-fastening upon engagement with each other.

* * * * *